US006468111B1

(12) United States Patent
Weng

(10) Patent No.: US 6,468,111 B1
(45) Date of Patent: Oct. 22, 2002

(54) ELECTRICAL PLUG

(75) Inventor: Hung-Chiun Weng, Hsinchu (TW)

(73) Assignee: Fu-Ting Liu, Hsinchu Hsien (TW)

( * ) Notice: Subject to any disclaimer, the term of this patent is extended or adjusted under 35 U.S.C. 154(b) by 102 days.

(21) Appl. No.: 09/610,522

(22) Filed: Jul. 7, 2000

(51) Int. Cl.[7] ..... H01R 13/68
(52) U.S. Cl. ..... 439/622
(58) Field of Search ..... 439/622, 621; 337/197, 198

(56) References Cited

U.S. PATENT DOCUMENTS 4,752,243 A * 6/1988 Meidan ..... 439/622
5,876,250 A * 3/1999 Deng ..... 439/622
5,984,730 A * 11/1999 Lu ..... 439/622
6,039,607 A * 3/2000 Cheung ..... 439/622

* cited by examiner

*Primary Examiner*—Gary Paumen
(74) *Attorney, Agent, or Firm*—Rosenberg, Klein & Lee

(57) ABSTRACT

The present invention proposes an improved structure of an electrical plug comprising an integrally formed hollow plug body. A movable retaining seat can be placed therein. The movable retaining seat is used for the replacing and checking of safety fuses. Because the groove opening of the movable retaining seat is situated on the plug plane, there is no gap on the housing of the plug, thereby achieving better waterproof characteristic. Moreover, a replaceable safety fuse is arranged therein to achieve better safety characteristic.

7 Claims, 8 Drawing Sheets

ELECTRICAL PLUG

FILED OF THE INVENTION

The present invention relates to an improved structure of an electrical plug and, more particularly, to a protective electrical plug, which is integrally formed and capable of preventing electrical appliances from burning due to power short.

BACKGROUND OF THE INVENTION

Along with the flourishing development of scientific technology, use of electrical appliances is indispensable in everyday works and lives. When electrical appliances are to be used, plugs need to be plugged into sockets to provide electricity. Therefore, the safety consideration of the structure of electrical plugs is very important so that much effort has been made to improve the structure of electrical plugs.

SUMMARY AND OBJECTS OF THE PRESENT INVENTION

The primary object of the present invention is to provide an electrical plug having better safety consideration and conforming to foreign safety specifications.

The secondary object of the present invention is to provide an electrical plug, which can be easily assembled and has safety fuses therein that can be conveniently replaced.

To achieve the above objects, the present invention uses an integrally formed plug body with a movable retaining seat installed at the plug plane thereof to form a safe and convenient plug.

The various objects and advantages of the present invention will be more readily understood from the following detailed description when read in conjunction with the appended drawings, in which:

DETAILED DESCRIPTION OF PREFERRED EMBODIMENT

Figure 1:
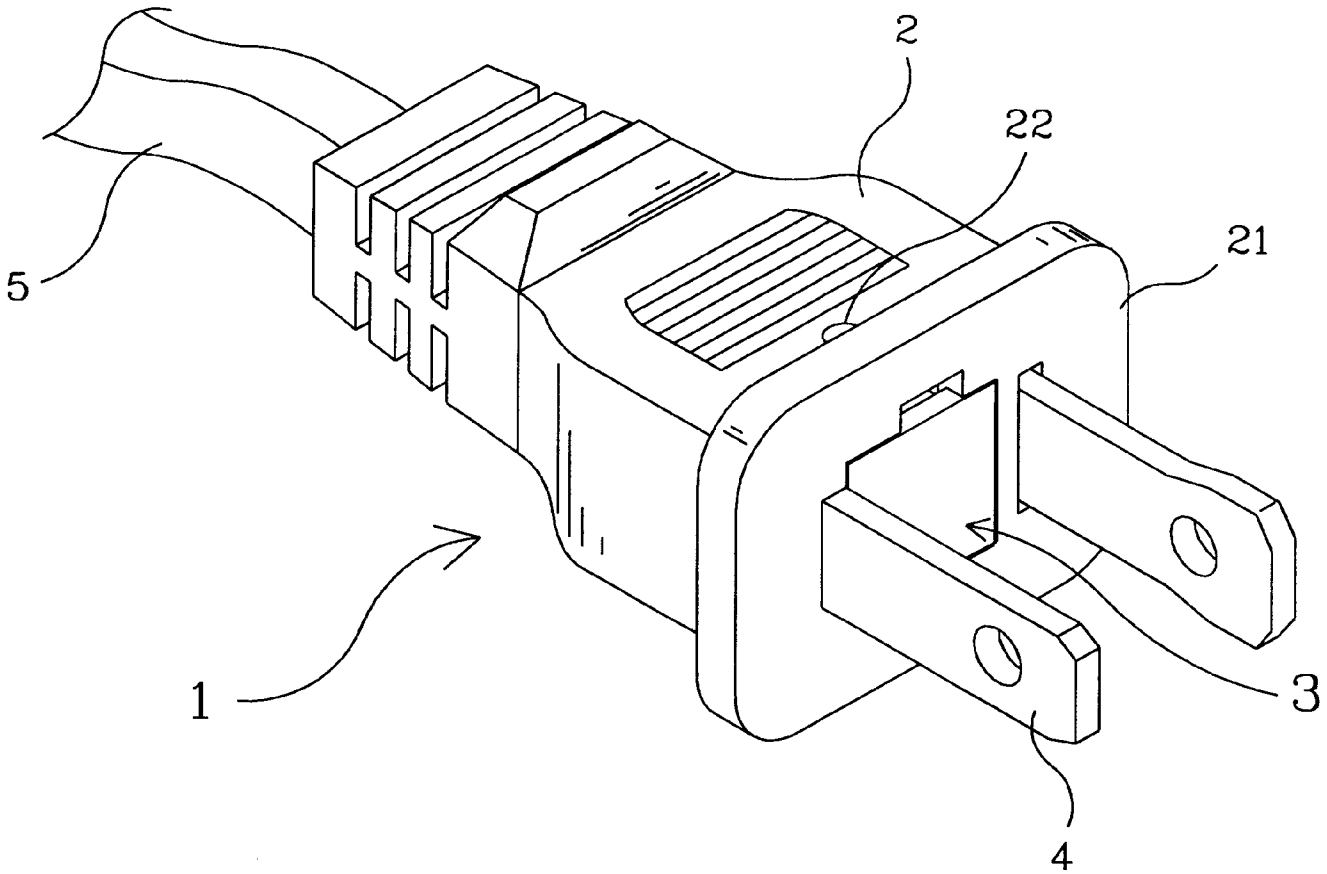
FIG. 1 is a perspective view of the present invention.

As shown in FIG. 1, the present invention comprises a housing 2, a power cord 5, and two conductive blades 4 to form an integrally formed hollow plug body 1. A movable retaining seat 3 can be placed therein to form a complete plug.

Figure 2:
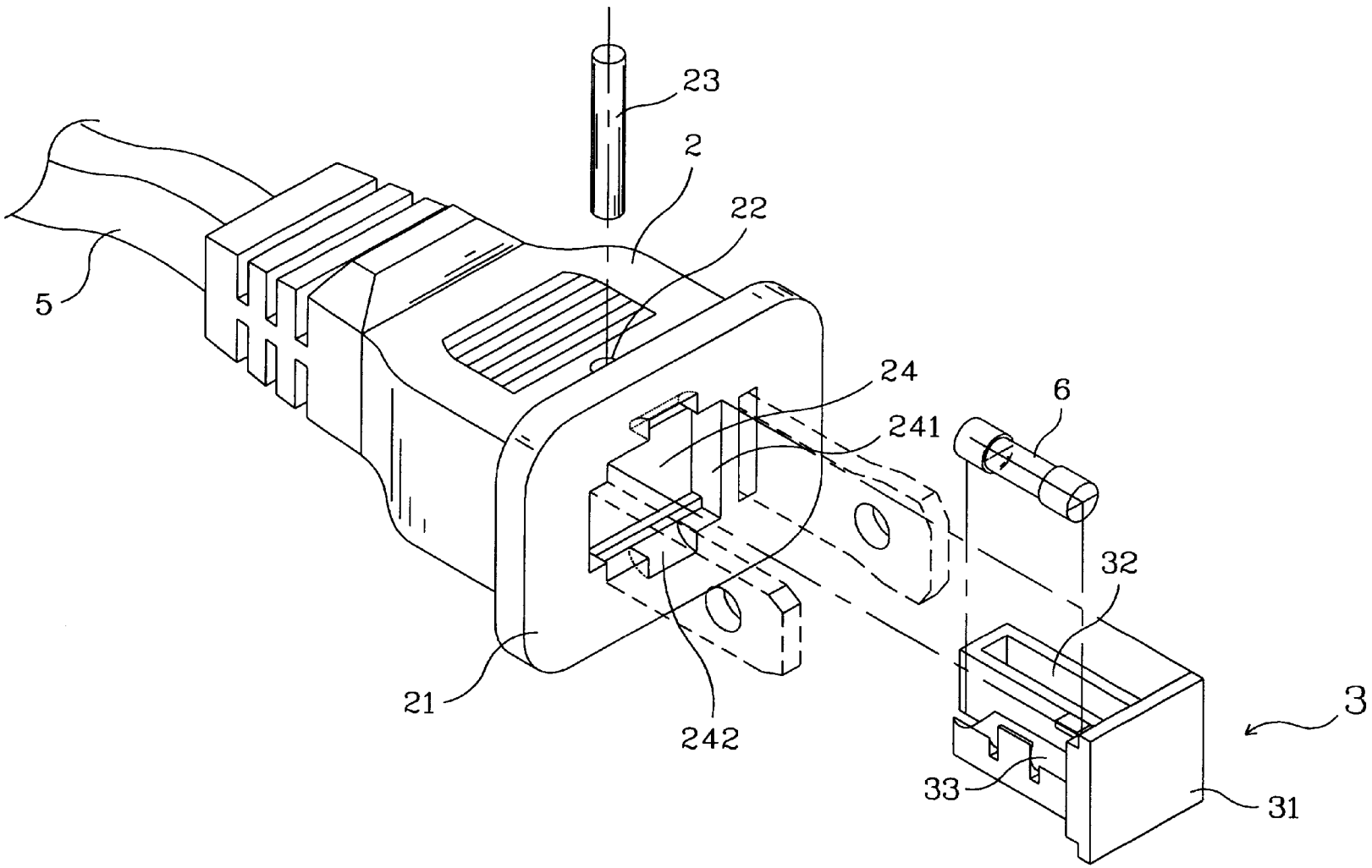
FIG. 2 is an exploded perspective view of the present invention.
Figure 3:
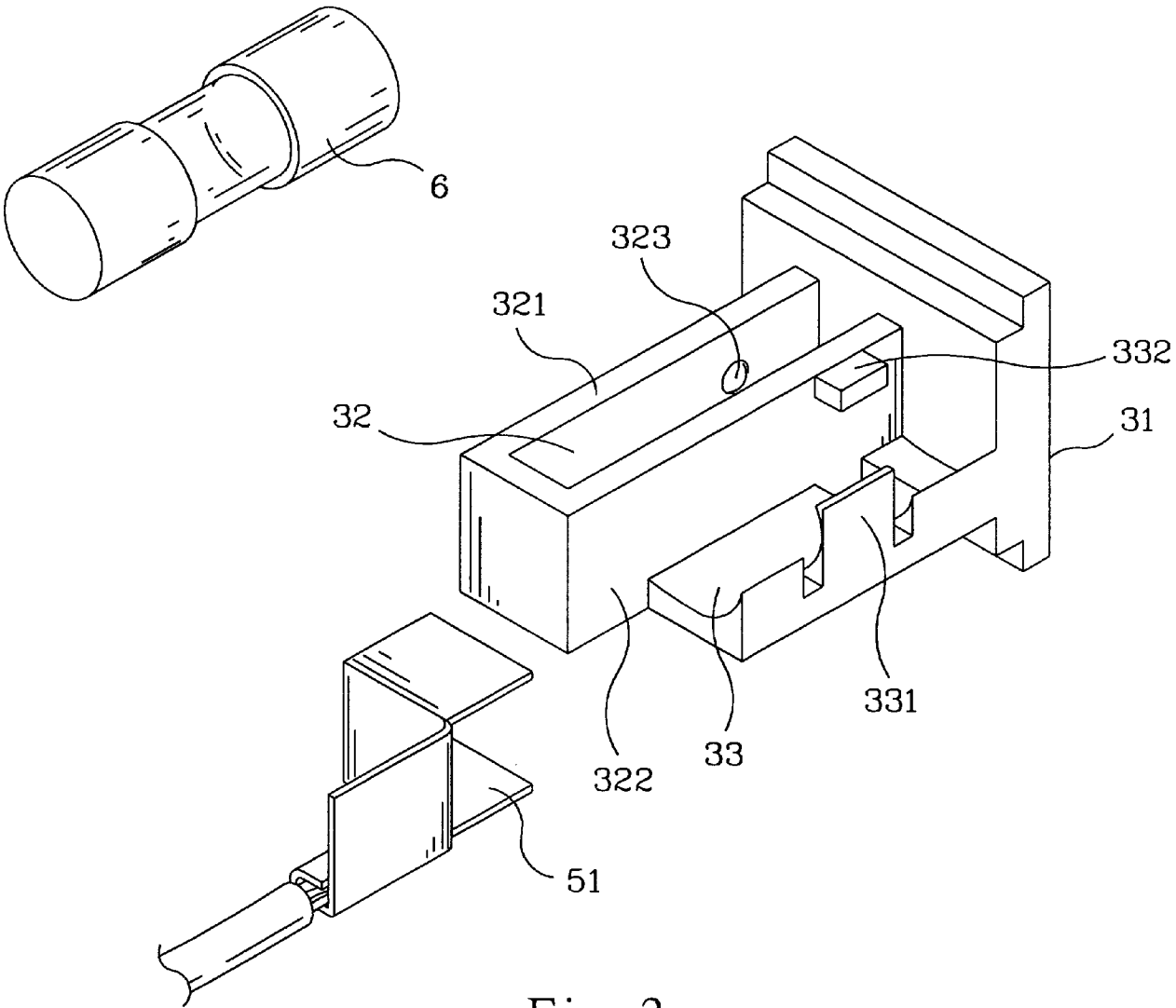
FIG. 3 is a structural diagram of the movable retaining seat of the present invention.
Figure 4:
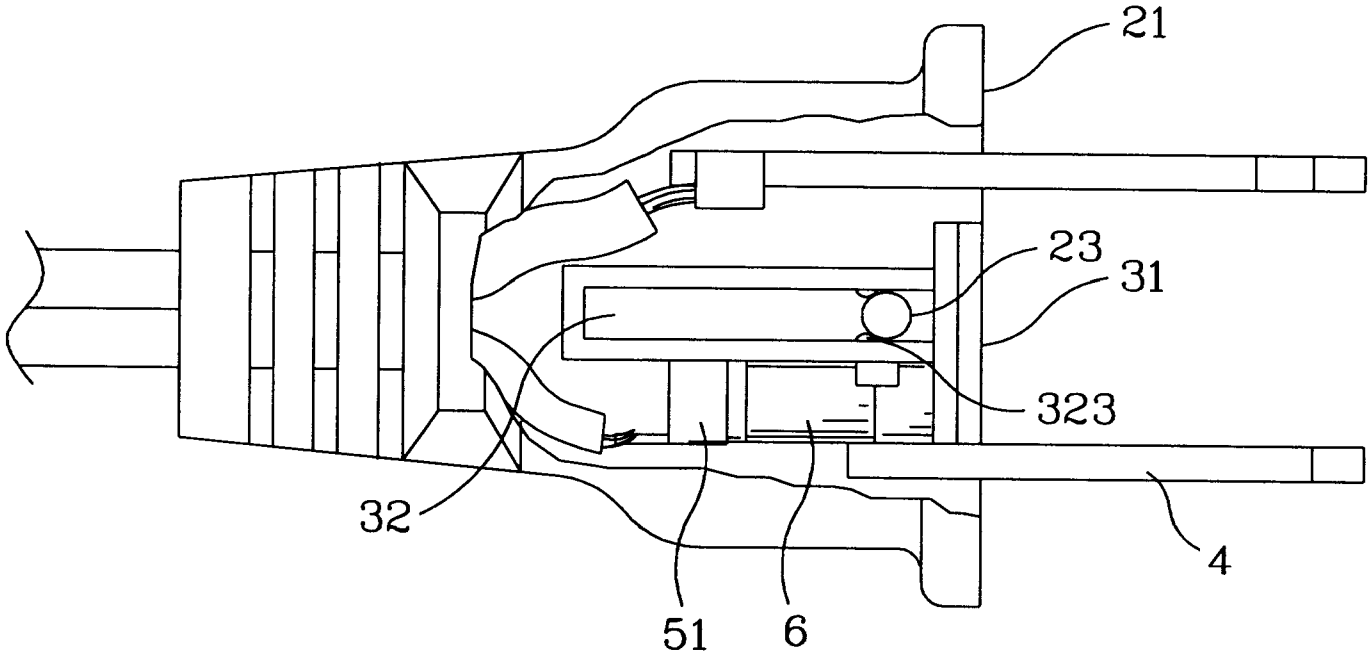
FIG. 4 is a cross-sectional view according to an embodiment of the present invention after the movable retaining seat is pushed inwards.

As shown in FIGS. 2 to 4, a groove opening 241 of a retaining groove 24 is disposed on a rectangular plug plane 21 where the plug is joined with the plug socket tightly. Step-like gaps 242 perpendicular to the conductive blades 4 are respectively formed at the centers of the upper and lower edges of the groove opening 241 near the plug plane 21. The movable retaining seat 3 can be exactly placed in the retaining groove 24. A groove 32 and a fuse seat 33 are installed on the movable retaining seat 3. A through hole 22 is disposed at a predetermined position on the housing 2. A through hole 22' (not shown) is also disposed at a corresponding position on the housing 2 so that a fixing bar 23 can penetrate the housing 2 through the through holes 22 and 22'. The fixing bar 23 can stand in the groove 32 of the movable retaining seat 3 so that the movable retaining seat 3 can only make restrained forward and backward movement. Projective points 323 are respectively formed at predetermined positions on the inner sides of two side boards 321 and 322 of the groove 32 to be secured to the fixing bar 323 to fix the movable retaining seat 3. The fuse seat 33 on the movable retaining seat 3 is used to allocate a safety fuse 6. A projective block 332 is formed at a predetermined position on the outer side of the side board 322. When the safety fuse 6 is placed in the fuse seat 33, the projective block 332 and a retaining plate 331 on the fuse seat 33 can fix the safety fuse 6 on the fuse seat 33. When the movable retaining seat 3 is pushed inwards, the fixing bar 23 will be secured to the projective points 323, and a front baffle 31 and the plug plane 21 will be on the same plane. Thereby, the conductive blades 4 can be successfully plugged into the plug socket. At this time, one end of the safety fuse 6 contacts with the conductive blades 4, while another end thereof contacts with a conductive seat 51.

Figure 5:
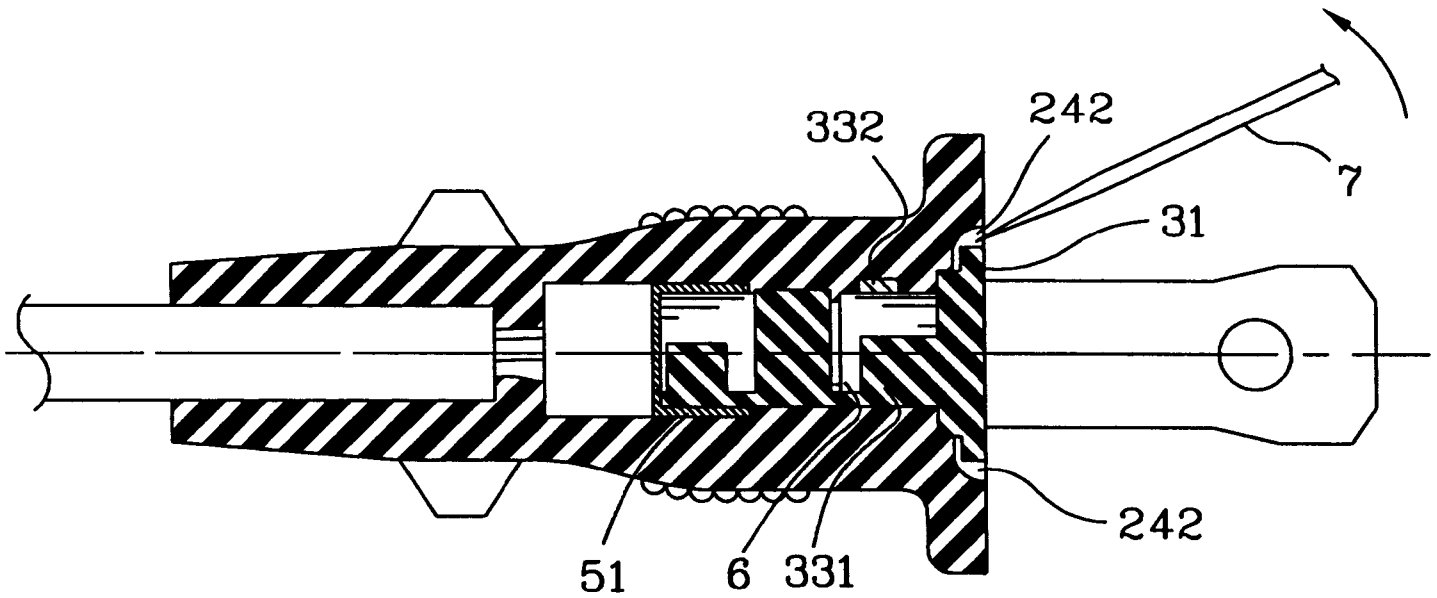
FIG. 5 is a cross-sectional view according to an embodiment of the present invention when the movable retaining seat is to be taken out.
Figure 6:
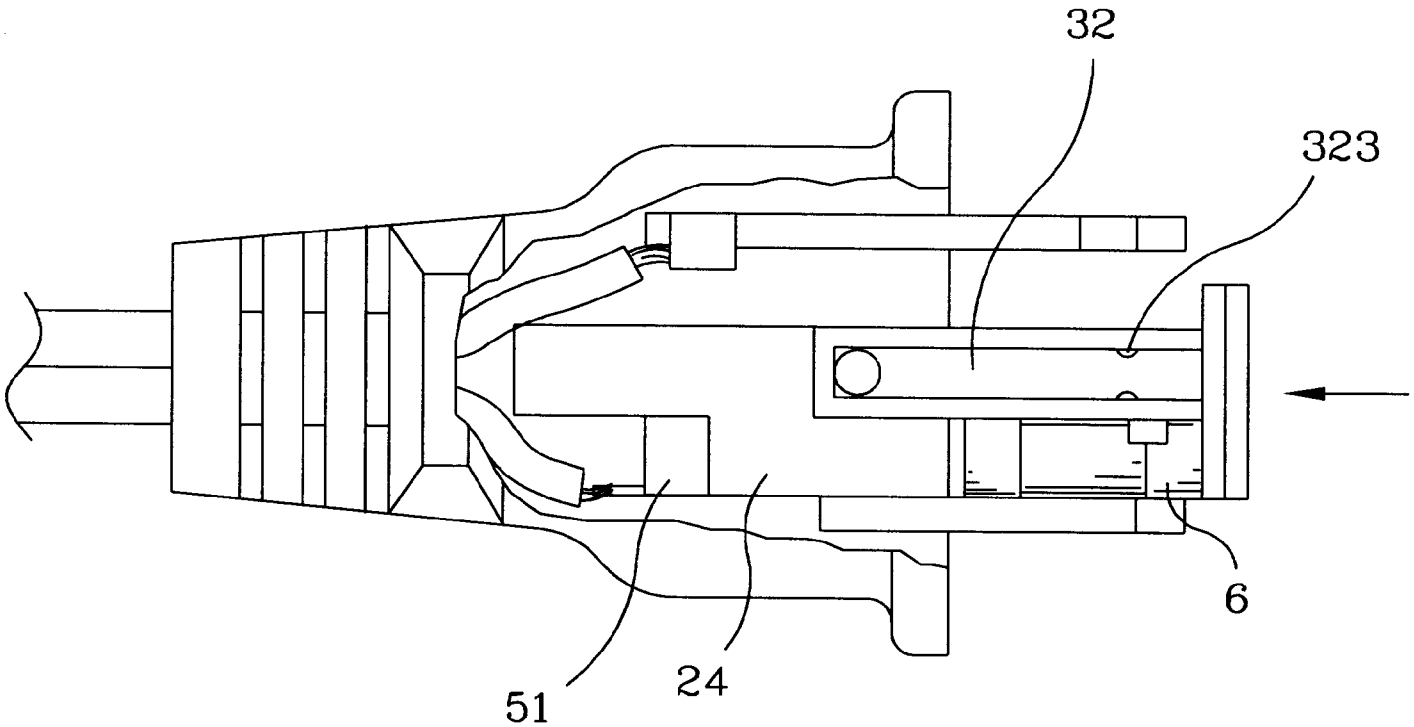
FIG. 6 is a cross-sectional view according to an embodiment of the present invention after the movable retaining seat is taken out.
Figure 7:
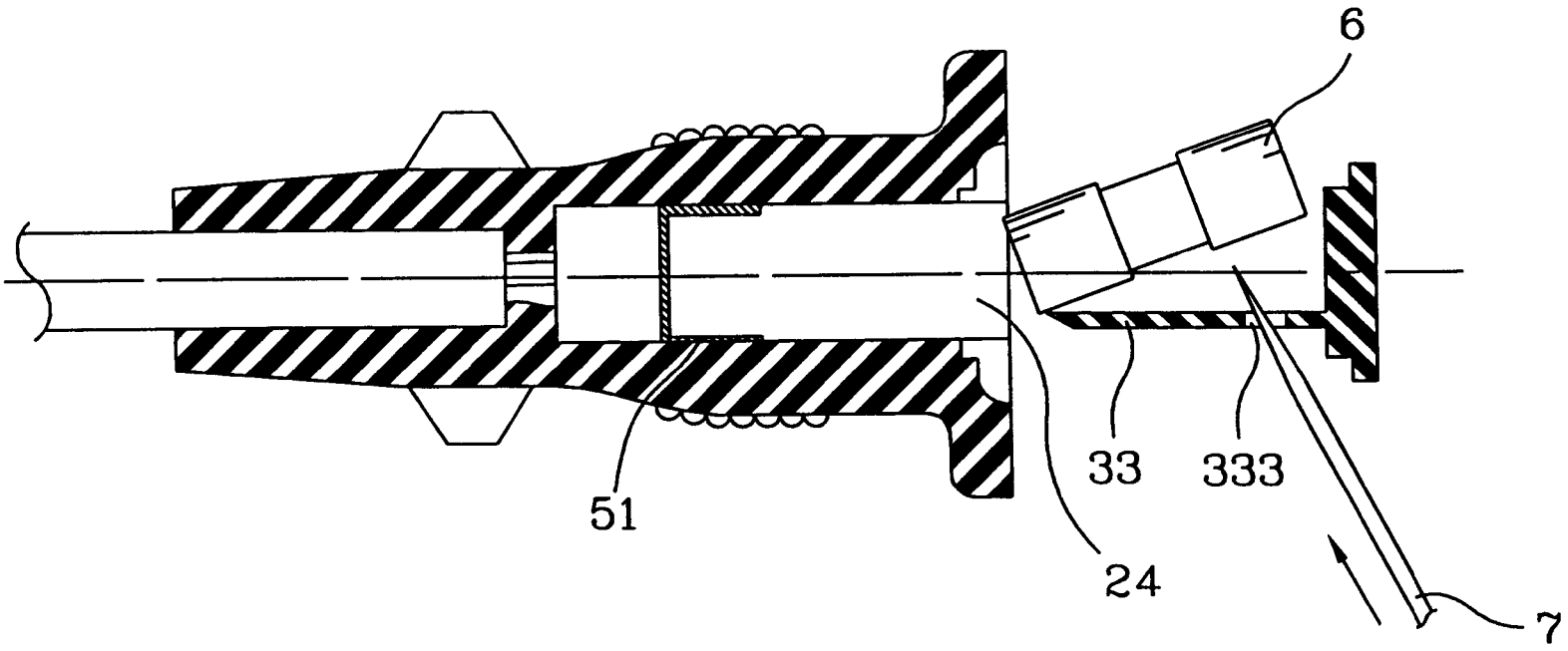
FIG. 7 is cross-sectional view according to an embodiment of the present invention when the safety fuse is being taken out.
Figure 8:
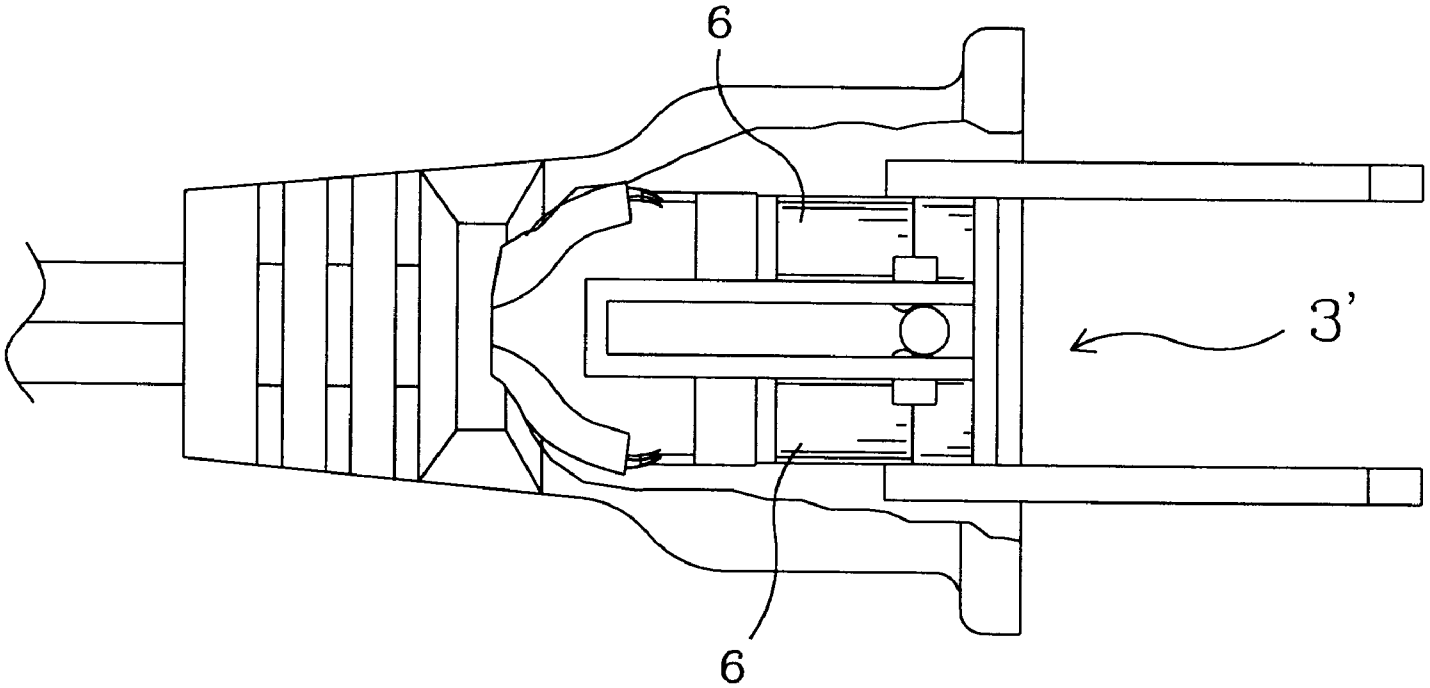
FIG. 8 is a cross-sectional view according to another preferred embodiment of the present invention having two safety fuses.

As shown in FIGS. 5 to 7, when the safety fuse 6 is to be replaced or checked, it is only necessary to insert a screwdriver 7 into the gap 242 to easily pry the front baffle 31 and pull out the movable retaining seat 3. Because the movable retaining seat 3 is limited by the fixing bar 23, it can only be pulled out a restrained length so as to prevent the movable retaining seat from dropping or missing. Moreover, because the pulled-out length will be longer than the two conductive blades 4, when the safety fuse 6 is to be replaced or checked, the plug should be completely drawn out of the plug socket, thereby increasing the safety. At this time, it is only necessary to insert the screwdriver 7 into a recessed hole 333 at the bottom of the fuse seat 33 to easily push up the safety fuse 6 and then replace a new safety fuse. As shown FIG. 8, a movable retaining seat having two fuse seats therein to allocate two safety fuses 6 can be achieved to form a plug having two safety fuses therein.

To sum up, because the plug of the present invention is integrally formed and sheathed in a layer of insulating material and has no gap thereon, a better waterproof characteristic can be achieved so that high safety can be maintained even if it is placed outdoors. Safety fuses can also be directly replaced, and the plug needs to be completed drawn out of the plug socket so as to reduce the danger when safety fuses are to be replaced. Moreover, the present invention conforms to foreign safety specifications.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An electrical plug comprising:

(a) a plug body including a housing coupled to a power cord and at least a pair of conductive blades extending therefrom, said housing having formed therein a longitudinally extended retaining groove, said housing defining a plug plane extending about a groove opening disposed substantially between the conductive plates in communication with said retaining groove;

(b) a movable retaining seat received in said retaining groove of said plug body housing for displacement between first and second positions, said movable retaining seat having a pair of side boards defining a longitudinally extended groove therebetween, each said sideboard having at least one projective point protruding therefrom into said groove, said movable retaining seat defining a fuse seat; and, (c) a fixing bar extending into said retaining groove of said plug body housing to transversely engage said groove portion of said movable retaining seat, said fixing bar being disposed for engagement with said projective points of said sideboards to releasably retain said movable retaining seat in said first position.

2. An electrical plug comprising:

(a) a plug body including a housing coupled to a power cord and at least a pair of conductive blades extending therefrom, said housing having formed therein a longitudinally extended retaining groove, said housing defining a plug plane extending about a groove opening disposed substantially between the conductive plates in communication with said retaining groove; and, (b) a movable retaining seat slidably received in said retaining groove of said plug body for longitudinal displacement between first and second positions relative to said plug body, said movable retaining seat including:

(1) a front baffle portion, said baffle portion in said first position being disposed within said groove opening in substantially coplanar alignment with said plug plane; and, (2) a fuse seat portion projecting longitudinally from said front baffle portion for carrying a fuse member, said fuse seat portion in said second position being disposed at least partially outside said retaining groove.

3. The electrical plug as recited in claim 2 further comprising a fixing bar extending transversely into said retaining groove of said plug body housing for slidable engagement with said movable retaining seat.

4. The electrical plug as recited in claim 3 wherein said movable retaining seat further includes a pair of side boards extending from said baffle portion to define a longitudinally extended groove portion therebetween, each said sideboard having at least one projective point protruding into said groove portion therefrom for engagement with said fixing bar to releasably retain said movable retaining seat in said first position.

5. The electrical plug as recited in claim 2 wherein said housing has formed respectively at upper and lower peripheries of said groove opening a pair of notched gaps for engagement access to said front baffle portion of said movable retaining seat.

6. The electrical plug as recited in claim 2 wherein said fuse seat portion of said movable retaining seat includes a transversely extended retaining plate for laterally supporting a fuse member carried thereon.

7. The electrical plug as recited in claim 2 wherein said fuse seat portion of said movable retaining seat has formed therein a bottom recessed access hole.

* * * * *